US006878040B2

(12) United States Patent
Wang

(10) Patent No.: US 6,878,040 B2
(45) Date of Patent: Apr. 12, 2005

(54) METHOD AND APPARATUS FOR POLISHING AND PLANARIZATION

(76) Inventor: Wei-Min Wang, 4182 Georgia Ave., Palo Alto, CA (US) 94306

( * ) Notice: Subject to any disclaimer, the term of this patent is extended or adjusted under 35 U.S.C. 154(b) by 127 days.

(21) Appl. No.: 10/233,233

(22) Filed: Aug. 30, 2002

(65) Prior Publication Data

US 2004/0043706 A1 Mar. 4, 2004

(51) Int. Cl.[7] ..... B24B 49/00
(52) U.S. Cl. ..... 451/11; 451/271
(58) Field of Search ..... 451/11, 5, 158, 451/159, 160, 278, 270, 271, 400, 272, 280, 291

(56) References Cited

U.S. PATENT DOCUMENTS 2,178,937 A * 11/1939 Nieder et al. ..... 451/271
4,979,334 A 12/1990 Takahashi
5,516,328 A * 5/1996 Kawada ..... 451/259
5,667,426 A 9/1997 Minami
5,947,797 A 9/1999 Buzzetti
6,042,459 A * 3/2000 Honda ..... 451/274
6,190,239 B1 2/2001 Buzzetti
6,471,570 B1 * 10/2002 Minami et al. ..... 451/271

OTHER PUBLICATIONS

Special Plane Curves: Hypotrochoid "http://xanlee.org/SpecialPlaneCurves_dir/hypotrochoid.dir/hypotrochoid.html" downloaded Feb. 4, 2003.

* cited by examiner

*Primary Examiner*—Dung Van Nguyen
(74) *Attorney, Agent, or Firm*—Howard E. Lebowitz

(57) ABSTRACT

This invention pertains to methods and apparatus for polishing and planarization of workpieces, such as fiber optics connectors, metallographic samples, semiconductor wafers, microelectronic substrate, optical devices and the like. The polishing pattern is a hypotrochoid generated by a spur gear rotating inside of an internal gear. The hypotrochoid is a superior polishing pattern because it not only provides a pattern similar to a figure eight pattern for producing optimal polishing conditions, but it also appears to precess around the center of the polishing space and maximize the utilization of the polishing pad or film.

18 Claims, 9 Drawing Sheets

METHOD AND APPARATUS FOR POLISHING AND PLANARIZATION

BACKGROUND OF THE INVENTION

1. Field of the Invention

This application pertains to methods and apparatus for polishing and planarization of work pieces, such as fiber optics connectors, metallographic samples, semiconductor wafers, microelectronic substrate, optical devices and the like.

2. Description of the Prior Art

The current state of the art of polishing specimens, comprising optical devices, fiber optics connectors, semiconductor wafers, micro-electronic substrate, metallographic samples, and the like largely derives from gemstone polishing machines that attempt to simulate the familiar figure eight motion which is generally recommended for hand polishing and lapping.

U.S. Pat. No. 5,667,426, which is hereby incorporated herein by reference, by Minami et al, is a method for polishing a ferrule on an optical connector by rotating an abrasive film comprised of a resin film having a layer of alumina particles disposed thereon with colloidal silicon dioxide abrasive. The film is on a rotating disk rotated by a rotating axle in a circular motion against the connector. Applying a circular motion from a rotating film has limitations. One limitation is that the linear velocity of polishing depends on the radial distance of the specimen from the center of revolution. For this reason, the method is usually applied to one circle of specimens, resulting in poor utilization of the polishing film area. Also the rotating disk lacks rigidity limiting the use of the method to dome shaped surfaces, rather than flat surfaces which require greater polishing precision.

Another rotating disk polishing machine, U.S. Pat. No. 4,979,334 by Takahashi, which is hereby incorporated herein by reference, discloses a polishing disk, supporting a polishing medium, wherein the polishing disk is made to rotate around its own axis while revolving about another axis by a rotating motor, a revolving motor and a complex mechanical mechanism. While this machine produces a better polishing effect by the combined rotating and revolving motion, the polishing disk is still a rotating disk with the drawbacks previously described for U.S. Pat. No. 5,667,426. Most of microelectronic substrate polishing and semiconductor wafer planarization incorporate those prior arts also.

U.S. Pat. Nos. 5,947,797 and 6,190,239, by Buzzetti, which are hereby incorporated herein by reference, disclose a method and polishing machine which produces a figure eight polishing pattern. The machine a polishing member mounted one of a pair of stages, wherein the pair of stages is interconnected for movement relative to each other. The polishing motion is generated by applying forces to each stage of the pair of stages to make the polishing member trace the desired path, a figure eight. The motion the stages is driven by two separate motors, one for each stage. The pattern is moved by displacing succeeding figure eight patterns by a distance. The stage moving motors are operated by an x-y controller operated by a computer. This machine is an improvement over its prior art with respect to the desirable figure eight polishing pattern and the ability to polish many pieces together. However the design is a complex one. Also the top stage extends over the bottom stage at either side of the movement. This leads to uneven stiffness across the polishing member and variations in polishing quality depending on work pieces' position. Also the displaced figure eight option to produce a moving polishing pattern is limited in its utilization of the polishing area.

The existing polishing and planarization machines either have the limitations of rotating disk machines with respect to polishing quality and radial variations, or have complex mechanisms to produce a more desirable pattern such as a figure eight polishing pattern. All existing machines require two or more motors to produce a polishing a pattern more complex than a circle and move across a polishing surface to avoid work pieces dwell on the same polishing location and causes polishing pad wore out prematurely There is a need for an improved polishing machine for producing a complex figure eight type polishing pattern while improving utilization of the polishing surface.

There is a need for a polishing machine with a simplified design wherein a complex figure eight type polishing pattern is generated using a single motor to drive a sturdy polishing platform with a simple mechanism.

SUMMARY OF THE INVENTION

A preferred embodiment of the invention is a polishing machine for polishing work pieces such as fiber optics connectors or chemical mechanical planarization (CMP) such as is applied to semiconductor wafer substrate. Polishing refers to smoothing of a surface which could be a convex, concave, planar, or complex surface, while planarization refers to the removal of topographic features from a plane surface. It will be understood that polishing includes planarization. One or more workpieces are held by a workpiece holder so that they are constantly in contact with a polishing table which moves about smoothly on a particular plane of the polishing/planarization machine, typically a substantially horizontal plane. The workpiece holder should be present for operation of the polishing machine, though in practice it will be seen that a variety of workpiece holders may be used depending on the nature of the workpieces to be polished. Preferably the polishing table comprises a permanent portion and a removable portion, typically a polishing pad or film, the removable portion being mounted on the permanent portion. The polishing table is pushed about the particular plane by a pin to form a polishing pattern. The pattern is generated by imparting the motion of a shaft which passes through the axis of a spur gear and rotates with the spur gear to the pin, when the spur gear is intermeshed with an internal gear and constrained to move along the inside circumference of the internal gear, and when the pin is displaced by a distance from the axis of the spur gear. The pattern generated is known as a hypotrochoid.

In the embodiment the polishing machine apparatus comprises an internal gear (a circular gear having teeth on the inside) and a spur gear (a circular gear having teeth on the outside. The spur gear is inside the internal gear and the teeth of the spur gear are intermeshed with the teeth of the internal gear. A rotating shaft passes through the axis of the internal gear. The rotating shaft may be driven directly by a motor or indirectly by gears or pulleys. The spur gear is attached to the shaft part of a crankshaft such that the crankshaft moves with the spur gear. A linkage bar is attached to the rotating shaft at one end and to the shaft part of the crank shaft on the other end, such that the rotation of the rotating shaft forces the spur gear to revolve about the axis of the internal gear(around the inside of the internal gear) while simultaneously rotating about its own axis and cranking the crank arm. A push pin is attached to the crank arm at a distance from the axis of the spur gear (the shaft of the crank shaft). The push pin drives a polishing table which is constrained to move freely on a plane. Workpieces to be polished are held in place in contact with the polishing table by a workpiece holder, which is part of a structure of the machine (discussed below). The workpiece holder is preferably stationary with respect to the structure, but may optionally move in a predetermined motion. Preferably the polishing table is comprised of a disposable or consumable part and a permanent part, the disposable part being mounted on the permanent part. The preferred operation is to have the polishing material on an expendable pad that can be replaced from time to time as it wears out. Different types and hardness of pads are most desirable for different types of workpieces.

The polishing machine preferably includes a support structure, having a lower portion and an upper portion separated by the top surface of a base. The internal gear, the spur gear, the rotating shaft, the linkage bar and the crank shaft are preferably disposed in the lower portion of the support structure and the polishing table is preferably located in the upper portion. The push pin extends between the lower portion and the upper portion connecting the crank shaft with the polishing table. The polishing table is mounted so that it is constrained to move on a predetermined plane, preferably a substantially horizontal plane. It must be able to move freely so that it can be pushed about by the push pin. This is accomplished by mounting the polishing table on a support mechanism which is mounted on the base. The support mechanism includes a first stage which is movably attached to the base, and a second stage (which includes the polishing table) which is attached to the first stage such that said first stage moves smoothly with respect to the base in a first direction and the second stage which is attached to the first stage moves smoothly with respect to the first stage in a second direction. Preferably the first direction and second directions are perpendicular to each other.

When the polishing machine operates, the pattern traversed is known as hypotrochoid, a family of curves generated by a first circle rotating inside a second circle without slipping while acting at a distance from the center of the first circle. In the embodiment, the first circle of the hypotrochoid is the spur gear, the second circle is the internal gear, and the distance from the center of the first circle is the distance along the crank arm from the centerline of the crankshaft shaft to the push pin. The properties of the hypotrochoid are completely determined by the diameter of the first circle, the diameter of the second circle, and the distance from the centerline of the crankshaft shaft and the pushpin.

The invention has many advantageous and useful features for lapping and polishing. Hypotrochoid patterns generated by the polishing machine of the invention can be designed to produce complex multi-lobed figure eight type patterns that attack work pieces from all directions which optimizing the polishing and lapping action and produce superior polishing and planarization results. The hypotrochoid can be either periodic or non-periodic depending on whether the ratio of the diameter of internal gear to the diameter of the spur gear is rational (periodic) or irrational (non-periodic). The period of a hypotrochoid refers to the number of rotations of the spur gear (first circle) until the pattern begins to repeat. Hypotrochoids with a large period or non-periodic hypotrochoids are very desirable since they can essentially fill the space with what approximates the precession of minutely displaced figure eight patterns around the surface making optimal use of the polishing surface.

It is also advantageous that the motion of the polishing table, according to the invention, is a smooth continuous motion. This continuous motion is preferred to polishing on a machine in which the motion is produced by manipulating motion with two or more motor drives each producing motion in different directions and physically displacing the curve at the end of a cycle to avoid repetition. The repositioning (precession) of the curve, in the instant invention, results simply from the fact that when the spur gear completes a revolution about the circumference, it is in a different position with respect to its own rotation about its axis than it was on the previous revolution. Thus the trace is displaced from the previous revolution. This results in the smooth and continuous motion.

Another advantage of the invention that the mechanism is simpler than other polishing machines that produce a figure eight type pattern because only one motor is required to produce the motion with only one contact to the mechanism that moves the polishing table.

It is an object of the invention to provide an improved method and polishing machine for polishing/planarization workpieces, such as a fiber optics connectors, optical devices, metallographics samples, semiconductor wafers/substrates or the like.

It is a further object to provide a method and a polishing machine of the type with a polishing surface that polishes workpieces in a figure eight type multi-lobed pattern, which pattern substantially fills the polishing surface with a smooth continuous motion, whereby improved use of the polishing surface is achieved.

It is a further object of the invention to provide a polishing machine of the type with a polishing surface that polishes workpieces in a figure eight type motion, with a simplified mechanism which requires only one drive motor to move the create the figure eight motion, whereby the reliability of the polishing machine is improved and the fabrication and operating costs reduced by use of said simplified mechanism.

It is a still further object of the invention to provide a polishing machine as described above with a rigid design such that uniform polishing is achieved independent of position of a workpiece on the machine.

BRIEF DESCRIPTION OF THE DRAWINGS

These and other features, aspects and advantages of the present invention will become better understood with regard to the following description, appended claims and accompanying drawings, where:

DESCRIPTION OF THE PREFERRED EMBODIMENTS

This invention provides a method and a polishing machine whereby workpieces are polished with an improved polishing pattern generated by the motion of a circular spur gear, having radial external radial teeth, moving inside of a circular internal gear, having internal radial teeth. The pattern is generated by a crankshaft through the axis of the first gear and driving a pushpin at a displacement from crankshaft along the crank arm.

Generation of the Polishing Pattern

The theory of the polishing motion is the geometry of a hypotrochoid, which is a figure generated by tracing the locus of a tracing point attached to a first circle rolling upon the inside of a second fixed circle without slipping, wherein the tracing point is at a distance from the center of the first circle. The first circle corresponds to the spur gear in the invention, the second circle corresponds to the internal gear and the distance of the tracing point from the center of the first circle corresponds to the distance along crank arm between the crankshaft and the pushpin.

Figure 1A:
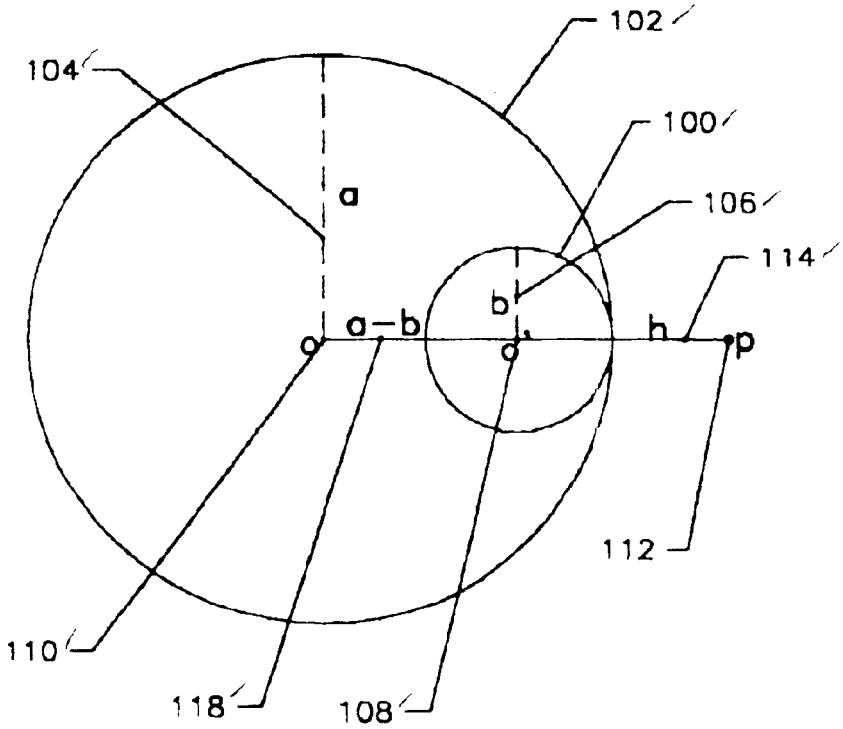
FIGS. 1A and 1B are drawings showing the geometric construction of a hypotrochoid at an initial point and a subsequent point in the construction.
Figure 1B:
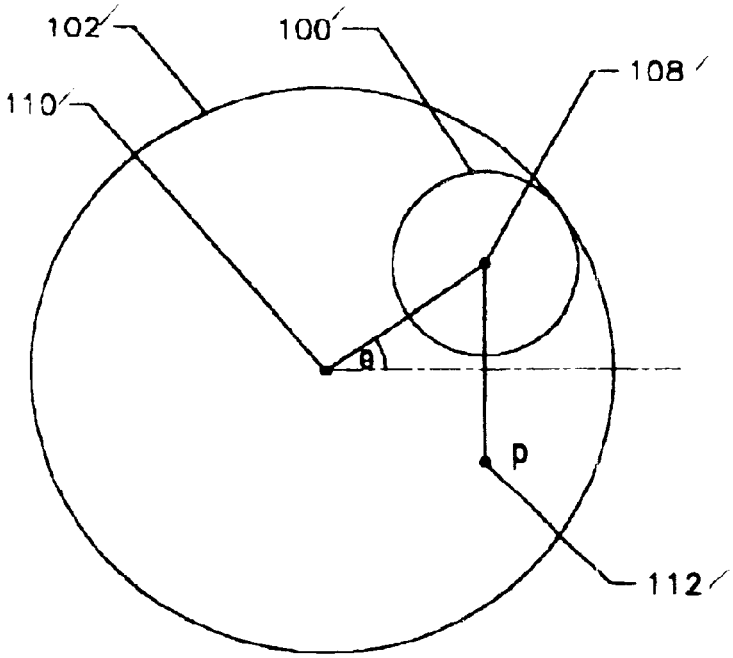

FIG. 1A shows a first circle 100 that can roll about the inner circumference of a second circle 102 without slipping. The first circle 100 has a center 108 and a radius 106 of length b. The second circle 102 has a center 110 and a radius 104 of length a. The line 118 between the center of the second circle and the center of the first circle has a length of a-b. The line 114 between the center of the first circle and the tracing point P 112 has length h.

It can be shown that the quantities a, b, and h define a unique hyptrochoid. FIG. 1A shows the circumstance after the first circle has rotated through an angle t inside the second circle. Note the motion of the tracing point P 112 as the first circle 100 simultaneously revolves about the axis of the second circle and rotates about its own axis.

The parametric equations for a hypotrochoid are given by equations (1) and (2) below:

$$x=(a-b)\cos(t)+h\cos((a-b)(t)/b) \quad (1)$$

$$y=(a-b)\sin(t)-h\sin((a-b)(t)/b) \quad (2)$$

Where t is the number of revolutions of the first circle around the second circle expressed in radians (2 pi radians per revolution). The parameter t can be traced from zero to infinity.

Hypotrochoids can be periodic or non-periodic depending on whether the ratio of a/b is rational (periodic) or irrational (non-periodic). The period of the hypotrochoid can be determined by reducing the ratio a/b to $1/b_1$ by dividing numerator and denominator by a. The hypotrochoid is periodic if $b_1$ is rational and non-periodic if $b_1$ is irrational. The period is the numerator of $b_1$ if $b_1$ is expressed as a fraction reduced to lowest terms. Thus, for example, if a=5 and b=2, then $b_1=2/5$ and the period is 2, whereas if a=51 and b=20, then $b_1=20/51$ and the period is 20. In this context, note that the period is defined as the number of revolutions of the first circle about the axis of the second circle before the pattern drawn by P begins to repeat. If the dimensions are $a=3(2)^{1/2}$ and b=2, then $b_1=2/((3)(2^{1/2}))$ and the hyptrochoid is non-periodic (never repeats).

Figure 2:
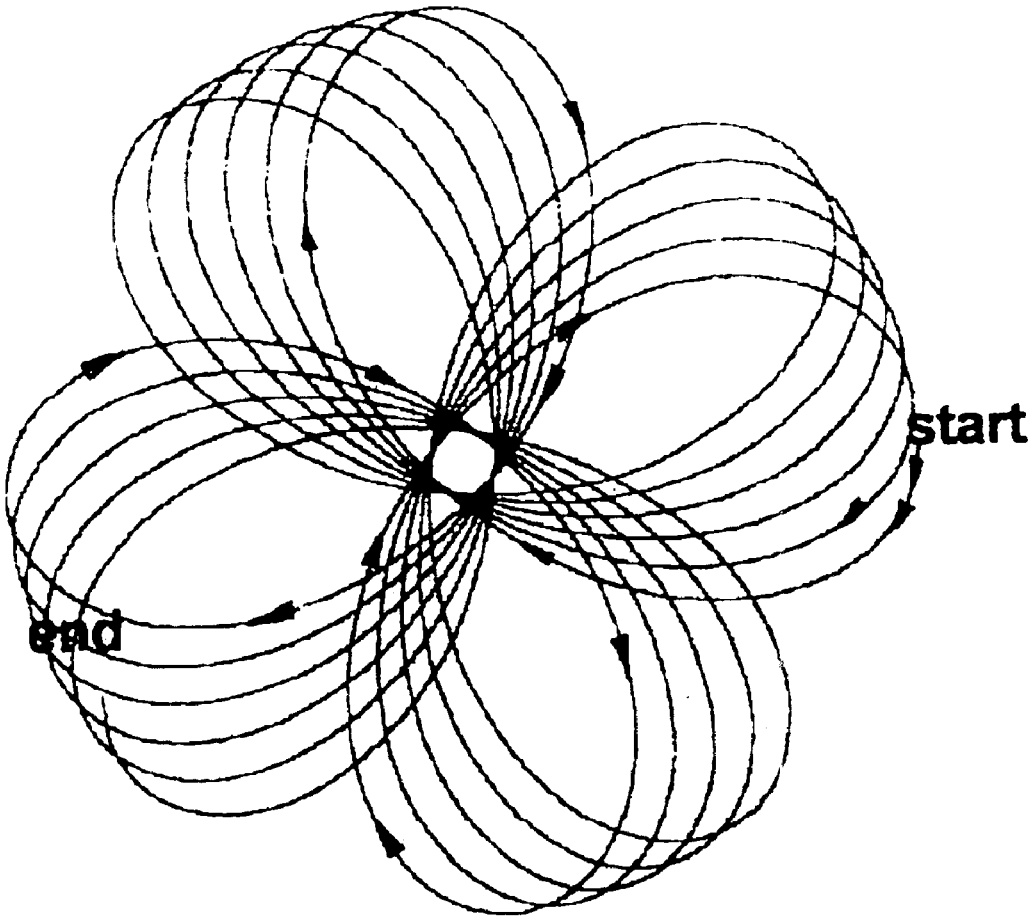
FIG. 2 is a drawing of the first few cycles of a hyprotrochoid.
Figure 3:
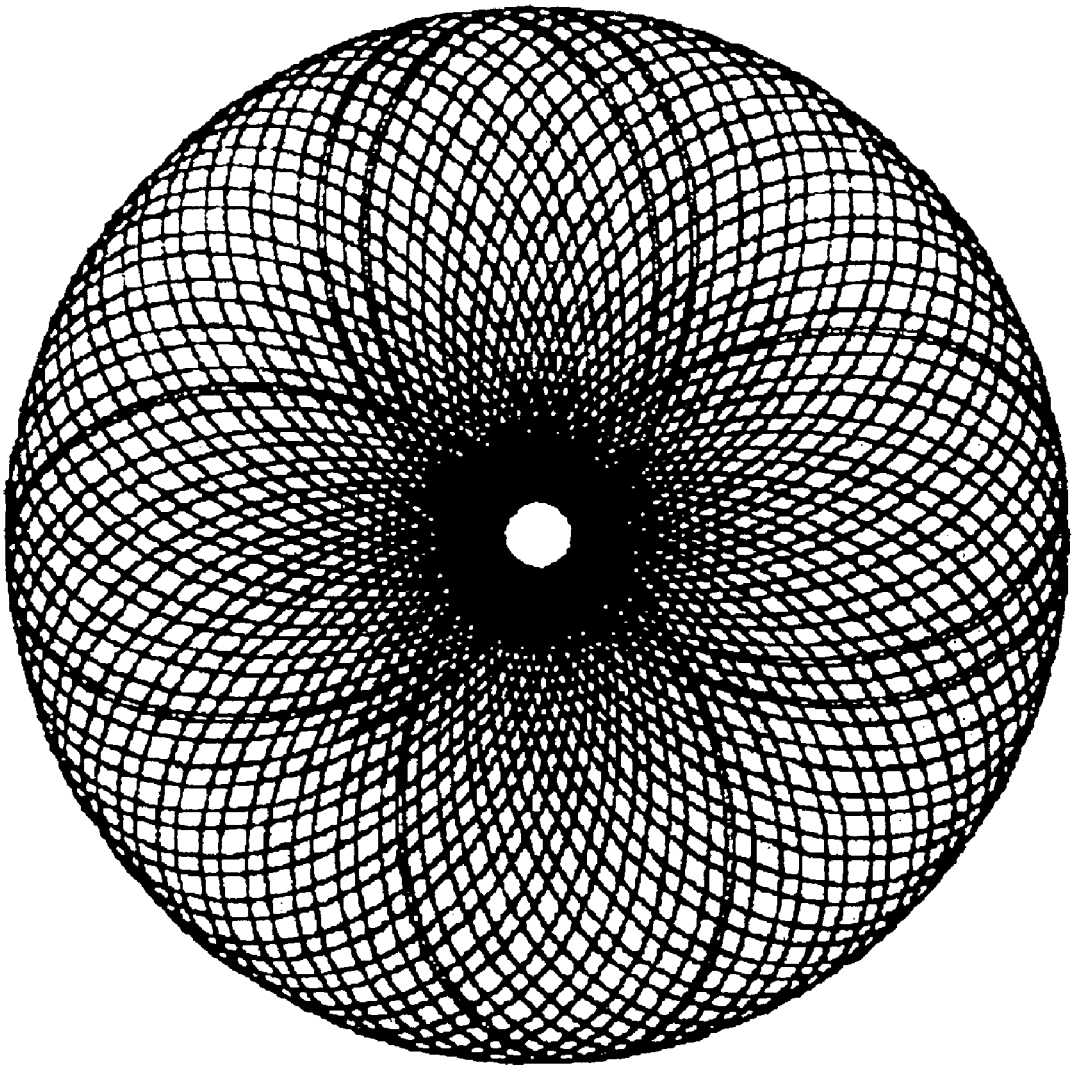
FIG. 3 is a drawing of the hypotrochoid after many cycles.

Hypotrochiods are shown in FIGS. 2 and 3. It will be appreciated by those skilled in the art that the patterns produced are excellent polishing patterns in that the figures polish in figure eight type motion while filling the space with the pattern. The patterns simulate a precession of figure eight patterns around the work piece. The most preferred curves for polishing are those having a hypotrochoid with a high period or non-periodic hypotrochoid. Of course, it is not necessary that curves be exact hypotrochoids, something that would be difficult in the field. It is only necessary that the curve be a reasonable approximation generated by two gears one turning about the inside of the other as previously described.

Description of Preferred Polishing Machines

Figure 4A:
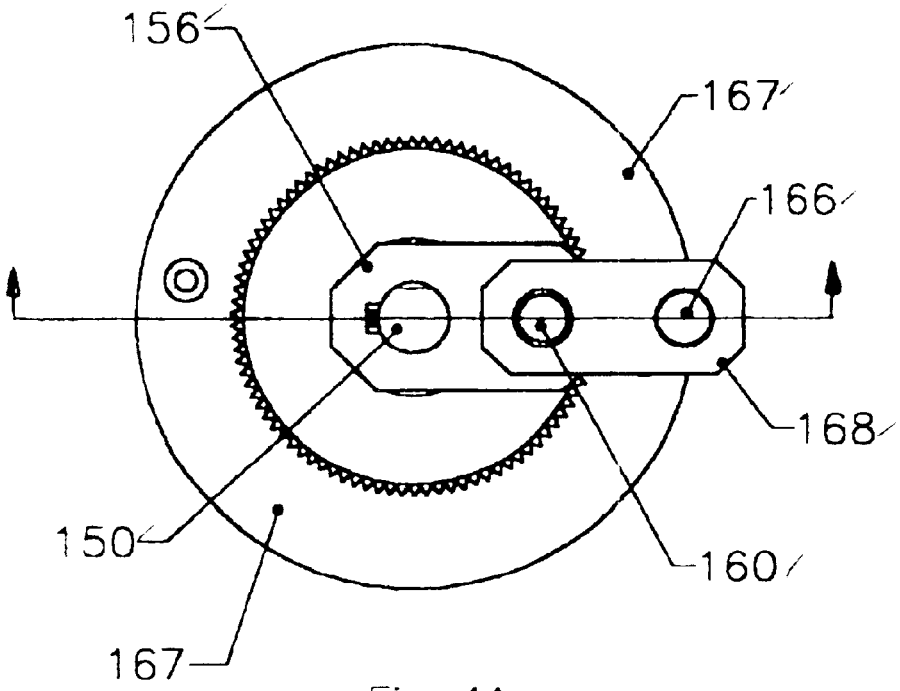
FIGS. 4A and 4B are plan and section views of the gear assembly for generating polishing motion in a preferred embodiment of the invention.
Figure 4B:
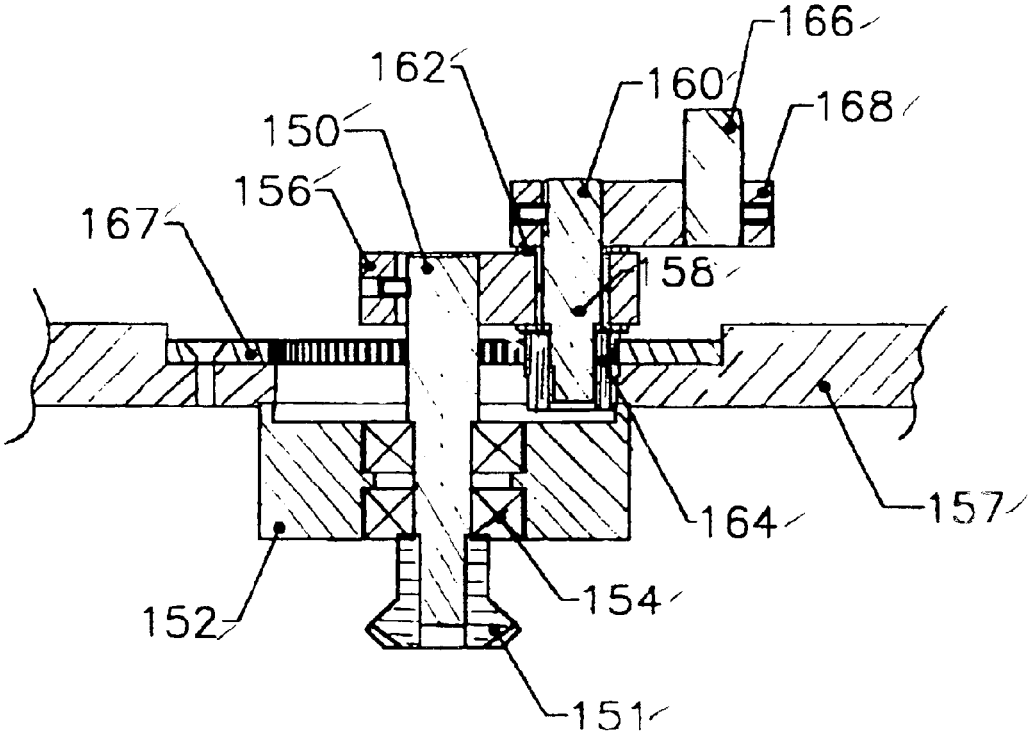

FIGS. 4A and 4B are plan and section views of the gear assembly for generating the polishing motion. A rotating shaft 150 is mounted on a block 152 with bearings 154 and this block 152 is mounted to a base 157. The shaft could be the output from a motor (not shown) or could be indirectly turned by gears or pulleys 151 attached to a motor. A stationary internal gear (a circular gear with radial teeth on the inside) 167 is installed on the base 157 with the rotating shaft 150 at its center. A linkage bar 156 is attached to the rotating shaft 150 on one end and has a mounting hole 158 on the other end. A crankshaft 160 is inserted into the mounting hole 158 with bearing bushings 162. A spur gear 164 is installed on one end of the crankshaft such that its teeth intermesh with the teeth of the internal gear 167. A push pin 166 that pushes a polishing table (not shown on this figure) is installed on the crank arm 168 at a distance from the crankshaft. When the rotating shaft 150 rotates, the linkage bar (156) drags the crankshaft and forces the spur gear 164 to roll inside the internal gear 167 cranking the crank arm 168. The push pin will trace a hyptrochoid as previously described as the spur gear revolves about the internal gear and rotates around its axis.

It is important to note an important feature of the invention that only a single motor drive applied to the rotating shaft is required to create the polishing pattern. The motion is imparted to a single push pin which drives the polishing surface.

The polishing table should be mounted on a support mechanism so that it can move freely on a plane, preferably a horizontal plane. Preferably, the support mechanism comprises a first stage movably attached to a support structure such that the first stage moves smoothly with respect to the support structure in a first direction and a second stage containing the polishing table is attached to the first stage such that the second stage moves smoothly with respect to the first stage in a second direction, angular to the first direction. The first direction and second direction are preferably perpendicular to each other.

Figure 5:
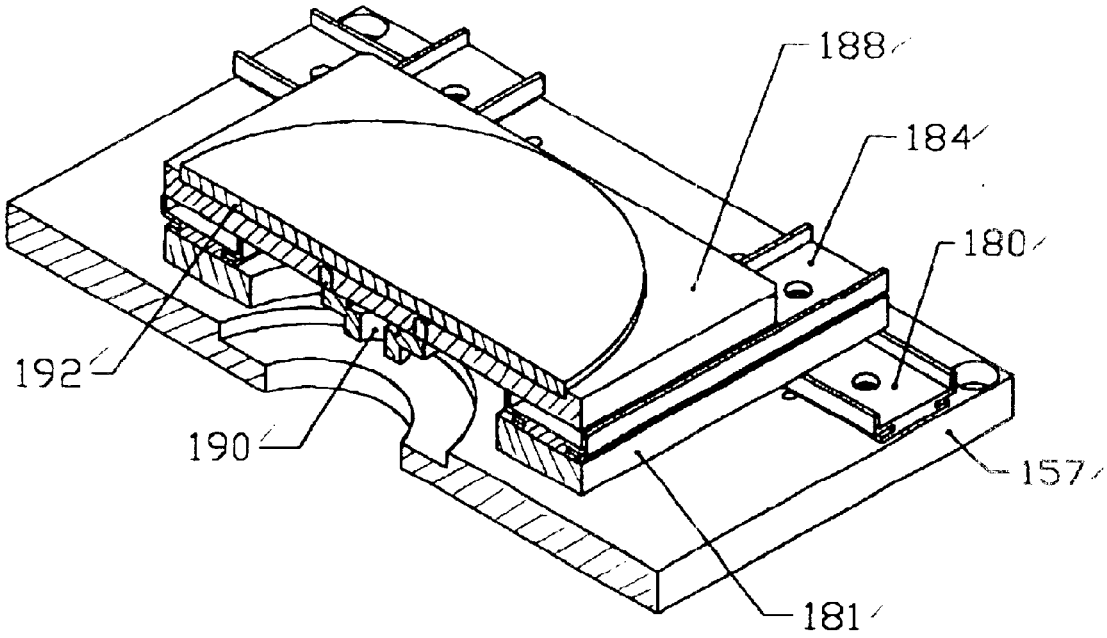
FIG. 5 is a cutaway isometric showing rails and slides as the polishing table support mechanism.
Figure 6:
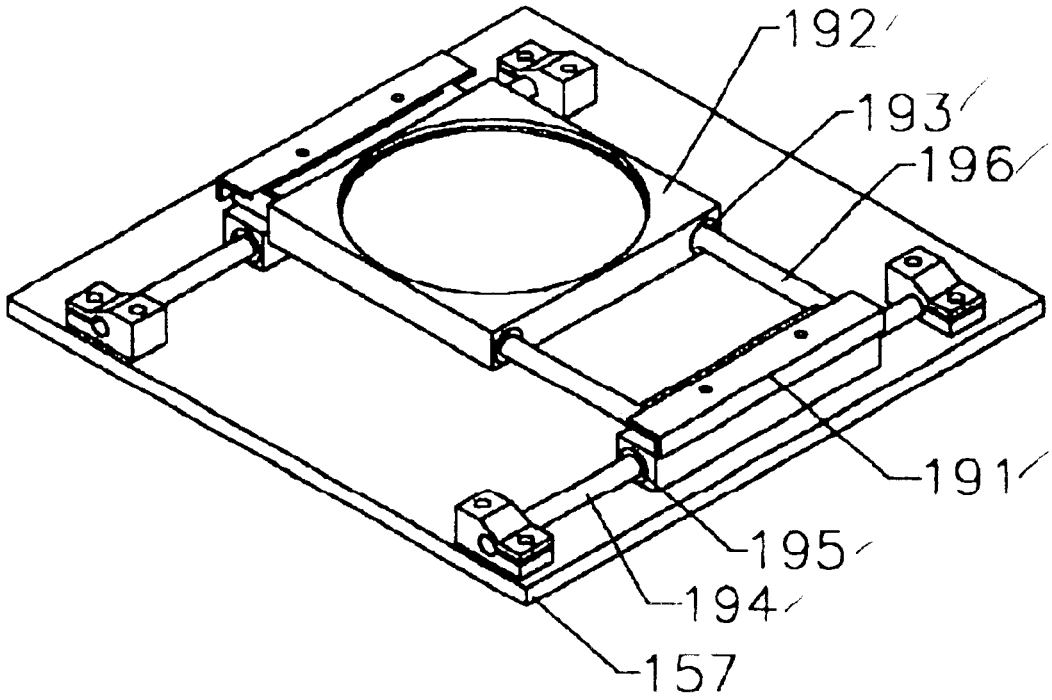
FIG. 6 is an isometric drawing showing an alternative table support mechanism using bushings and rails.
Figure 7:
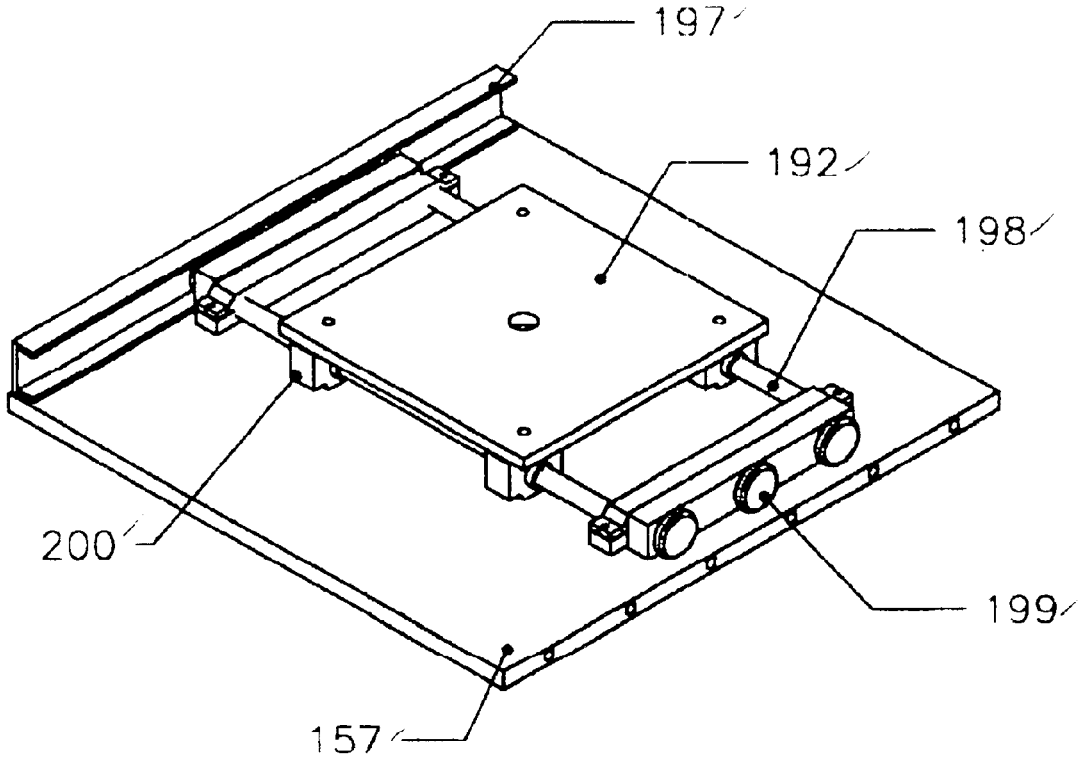
FIG. 7 is an isometric drawing showing a second alternative support mechanism using bushings and rollers.

FIGS. 5, 6 and 7 illustrate three preferred platforms for mounting a polishing table. FIG. 5 is cutaway illustrating half of a platform using rails and slides as the stages. Referring to FIG. 5, a first pair of rails 180 is mounted in a fixed position to the base 157. A second pair of rails 184 is mounted on a second base 181 with slides, on the first pair of rails such that the second pair of rails can move freely along the first set of rails in the direction of the first set of rails. The polishing table 188 is mounted on the second set of rails with slides which allow the polishing table to move along the second pair of rails in the direction of the second pair of rails on the first pair of rails. The polishing table is driven by the push pin 166 which engages in the swivel bushing 190. The push pin can drive the polishing table freely on a horizontal plane, within the physical constraints imposed by the rails. A removable polishing pad 192 is shown on the polishing table. It should be noted that the pad need not be circular as shown and may be rectangular, or square.

FIG. 6 shows an alternative table support mechanism using bushings and shafts in place of the rails and slides in the FIG. 5 embodiment. Referring to FIG. 6, a pair of shafts 194 are mounted fixedly on the base 157. Bushing block 195 slides along the shafts 194 in a first direction. The polishing table 192 is mounted on a second pair of shafts 196 through bushing guides 193 built into the polishing table attached on bushing block 195 by holding plate 191, such that the polishing table moves freely in a second direction, which is perpendicular to the first direction. As in the previous embodiment the pushpin can drive the polishing table on a horizontal plane within the constraints of back and forth motion along the two pairs of shafts.

FIG. 7 shows a second alternative support mechanism that is a hybrid of the embodiments illustrated on FIG. 5 and FIG. 6. In this embodiment a first stage comprising two vertical rails 197(only one shown) are attached to the base 157. A second stage comprising two shafts 198 moves along the two vertical rails 197 with rollers 199 in a first direction. The polishing table 192, moves back and forth along the two shafts 198 through bearing block 200 attached to the polishing table in a second direction that is perpendicular to the first direction. As in the previous embodiment the pushpin can drive the polishing table on a horizontal plane within the constraints of back and forth motion along the rails and shafts.

Figure 8:
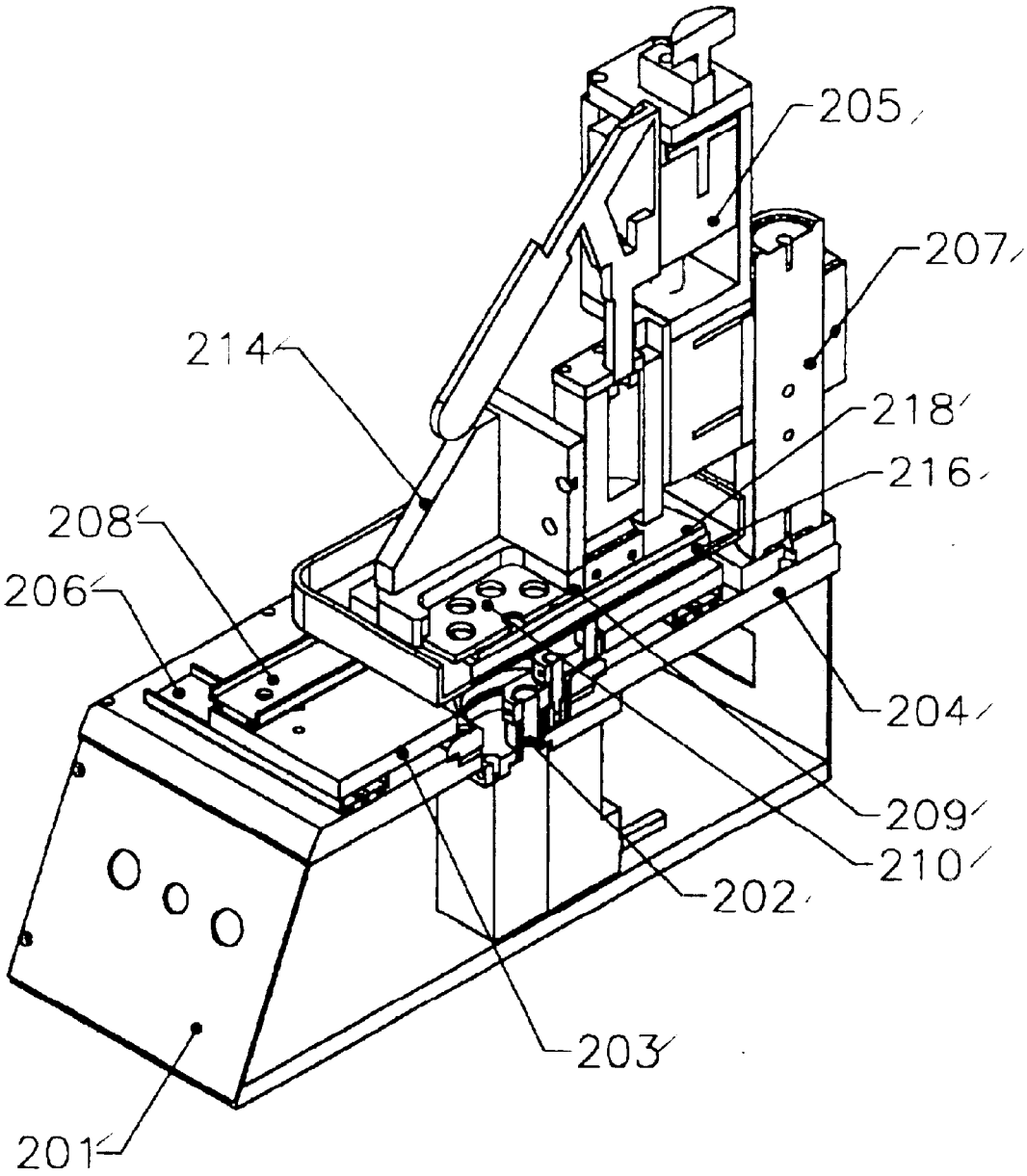
FIG. 8 is a sectional isometric drawing of a polishing machine embodiment.
Figure 9:
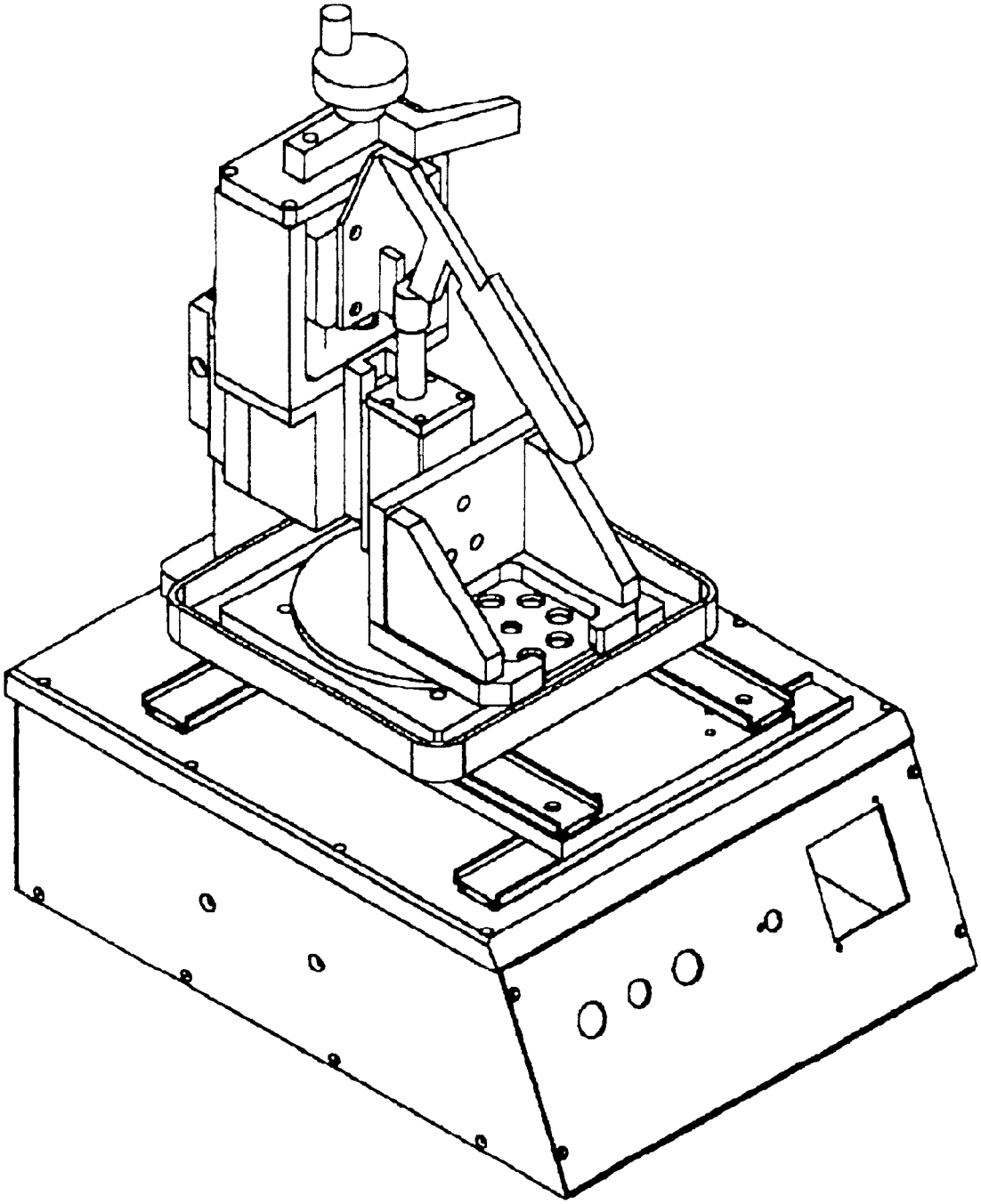
FIG. 9 is a full isometric drawing of a polishing machine embodiment.

FIG. 8 shows a preferred embodiment of an assembled polishing machine's section view. A metal support structure 201 has a lower part 202 containing the mechanism for generating the polishing pattern. The push pin extends between the lower part and an upper part separated by the top of base 204. A first pair of rails 206 is mounted in a fixed position on the base. A second pair of rails 208 is mounted on a second base 203 with slides sliding on the first pair of rails so that they move freely in the direction parallel to the first pair of rails. The polishing table 216 is mounted on the second set of rails with slides such that the polishing table can move on the second pair of rails in a direction perpendicular to the motion of the second pair of rails on the first pair. A workpiece holder 214 holds workpieces holding fixture 210 or workpiece itself against the polishing pad 218 supported on the polishing table 216. The workpiece holder is preferably stationary with respect to the support structure, but may optionally be movable in a predetermined motion. Between the work piece holder and holding fixture, there is preferably an elastomer layer 209 to provide necessary compliance to assure the work pieces are polished against precision fabricated polishing pad and optimal polishing/planarization quality can be achieved readily. FIG. 8 also discloses the lifting and polishing force control structure 205 and 207. The FIG. 9 shown the full isometric view of preferred embodiment.

Design and Use Considerations

Depending on the nature of the workpieces to be polished, various polishing pads will be used. The types of polishing pads are well known in the art. For instance, rubber or soft pads are used for fiber optic connectors with a dome shaped end surface. The dome radius of the polished surface is controlled by the rubber pad hardness and the pressure applied by the workpiece holder. Weights, springs, pneumatic or electrical forces can be applied to the workpiece holder to control pressure. Smooth hard pads are used for polishing a flat work piece or wafer or solder bump planarization.

It will be appreciated by those skilled in the art that polishing machines according to the invention can be scaled to various sizes according to the invention, depending on the size and number of workpieces. The rigid steady stage arrangement provides solid support independent of size for consistent polishing performance and high throughput.

Polishing machines can be made to polish a single workpiece or a plurality or multiplicity of workpieces spaced about the polishing table. Depending on the amount of movement desired the design equations are equations (1) and (2) as previously defined where, a is the radius of the internal gear, b is the radius of the spur gear, and h is the distance along the crank arm from the center of the crankshaft to the center of the push pin. The motion can be readily computed by plotting the hypotrochoid curve for one period if the curve is periodic or for enough revolutions to define the boundaries of the curve if non-periodic. Non-periodic or hypotrochoids with a large period, approximately 10 or higher are preferred. The ratio a/b can be readily manipulated to produce a polishing motion that effectively fills the polishing space, with the size of the curve manipulated with the parameter h.

A polishing machine according to the invention is a simple and elegant apparatus for polishing a workpiece with a complex figure eight pattern which polishes the workpiece from nearly every direction and improves the state of the art in both quality of polishing and simplicity of design.

A polishing machine according to the invention requires only one motor driving a single push pin to provide complex figure eight type polishing motion approximating a figure eight precession filling the polishing space.

Although the present invention has been described in considerable detail with reference to certain preferred versions thereof, other versions are possible. Therefore the spirit and scope of the appended claims should not be limited to the preferred versions herein.

I claim:

1. A polishing and planarization machine comprising:

a) an internal gear having an axis;

b) a rotating shaft rotating through the axis of said internal gear, c) a spur gear intermeshed with said internal gear and disposed to move about the internal circumference of said internal gear;

d) a crankshaft having a shaft part and a crank arm, said shaft part being inserted into said spur gear at a first end;

e) a linkage bar connecting said rotating shaft with said shaft part of said crankshaft at a second end, such that the rotation of said rotating shaft forces said spur gear to revolve about the axis of said rotating shaft and to rotate about its own axis cranking said crank arm;

f) a push pin, said push pin, displaced from the axis of said spur gear, and driven by said crank arm along a locus, whereby said locus approximates a hypotrochoid; and g) a polishing table assembly comprising a polishing table and a support mechanism, the polishing table mounted on the support mechanism such that the polishing table moves freely on a first plane and is driven by said push pin.

2. The polishing and planarization machine of claim 1, further comprising a workpiece holder, said workpiece holder being capable of holding at least one workpiece in contact and compliance with said polishing table in an orientation substantially normal to said first plane as the polishing table moves.

3. The polishing and planarization machine of claim 2 wherein the polishing table comprises a permanent portion and a removable portion, said removable portion being mounted on the permanent portion of said polishing table.

4. The polishing and planarization machine of claim 2, wherein the polishing machine further comprises a support structure, said support structure supporting said support mechanism.

5. The polishing and planarization machine of claim 4 wherein said support mechanism comprises a first stage attached movably to said support structure, a second stage containing said polishing table, attached movably to said first stage such that said first stage moves smoothly with respect to said support structure in a first direction, and said second stage moves smoothly to said first stage in a second direction angular to said first direction.

6. The polishing and planarization machine of claim 5, wherein said second direction is substantially normal to said first direction.

7. The polishing and planarization machine of claim 5 wherein said workpiece holder is movable in a predetermined pattern with respect to said support structure.

8. The polishing and planarization machine of claim 1 wherein the ratio of diameter of said internal gear to the diameter of said spur gear is an irrational number, whereby said locus approximates a non-periodic hypotrochoid.

9. The polishing and planarization machine of claim 1 wherein the ratio of diameter of said internal gear to the diameter of said spur gear is an rational number, and wherein said locus approximates a periodic hypotrochoid having a period greater than about 4.

10. The polishing and planarization machine of claim 1 wherein the ratio of diameter of said internal gear to the diameter of said spur gear is between about 2 and about 8.

11. The polishing and planarization machine of claim 1 wherein the ratio of diameter of said internal gear to the diameter of said spur gear is between about 3 and about 5.

12. A method of polishing comprising the steps of:

a) mounting at least one workpiece in contact with a polishing table, wherein said polishing table is free to move freely on a plane, and b) pushing said polishing table about said plane with a pin to form a pattern, the pattern being generated by imparting the motion of a crank arm to the pin, the crank arm being connected to a shaft through the axis of a spur gear and rotating with the spur gear; while the spur gear is intermeshed with and moving along the inside circumference of an internal gear, whereby the pin is displaced a distance from the axis of the spur gear by the crank arm, and said pattern approximates a hypotrochoid.

13. The method of claim 12 wherein the ratio of the diameter of said internal gear to the diameter of said spur gear is an irrational number, whereby said pattern is non-periodic.

14. The method of claim 13 wherein the polishing table comprises a permanent portion and a removable portion, said removable portion being mounted on said polishing table, wherein said removable portion is chosen from the group consisting of polishing pads and polishing films.

15. The method of claim 14 wherein the at least one workpiece comprises at least one item chosen from the group consisting of wafer substrates and circuit substrates and fiber optics connectors.

16. The method of claim 12 wherein the ratio of the diameter of said internal gear to the diameter of said spur gear is a rational number, wherein said pattern is a periodic hypotrochoid having a period greater than about 4.

17. The method of claim 16 wherein the polishing table comprises a permanent portion and a removable portion, said removable portion being mounted on said polishing table, wherein said removable portion is chosen from the group consisting of polishing pads and polishing films.

18. The method of claim 17 wherein the at least one workpiece comprises a plurality of items chosen from the group consisting of wafer substrates and circuit substrates and fiber optics connectors.

* * * * *